US006284380B1

(12) United States Patent
Martin et al.

(10) Patent No.: US 6,284,380 B1
(45) **Date of Patent: *Sep. 4, 2001**

(54) PAPER MACHINE CLOTHING AND A METHOD OF COATING SAME

(75) Inventors: Chad Aaron Martin, Menasha, WI (US); Bryan Casteel, Oxford, OH (US)

(73) Assignee: Albany International Corp., Albany, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/804,624

(22) Filed: Feb. 25, 1997

(51) Int. Cl.[7] ..... B32B 27/00

(52) U.S. Cl. ..... 428/422; 139/383 A; 427/389.9; 427/393.4; 428/421; 442/60; 442/72; 442/148

(58) Field of Search ..... 139/383 A; 428/421, 428/422; 442/60, 72, 148; 427/389.9; 422/393.4

(56) References Cited

U.S. PATENT DOCUMENTS

| | | | | |
|---|---|---|---|---|
| 4,446,092 | * | 5/1984 | Bliley . | |
| 4,504,530 | * | 3/1985 | Bliley . | |
| 5,002,801 | * | 3/1991 | Barnewall | 427/389.9 X |
| 5,019,428 | * | 5/1991 | Ludcmann et al. | 427/393.4 X |
| 5,207,873 | * | 5/1993 | Sanduja et al. | 427/389.9 X |
| 5,508,095 | * | 4/1996 | Allum et al. | 428/421 X |

* cited by examiner

*Primary Examiner*—Bernard Pianalto
(74) *Attorney, Agent, or Firm*—Pitney, Hardin, Kipp & Szuch, LLP

(57) ABSTRACT

The present invention is directed to fabrics for paper making machines that are rendered contamination resistant, maintain good permeability, and enhanced seam strength as a result of a durable coating that lasts the entire life of the fabric. A polyurethane based coating containing a fluorochemical will render the fabric contamination resistant over the entire fabric lifetime. It has been found that optical brighteners and titanium dioxide also enhance fabric appearance.

69 Claims, 3 Drawing Sheets

PAPER MACHINE CLOTHING AND A METHOD OF COATING SAME

FIELD OF THE INVENTION

The present invention is directed to fabrics for paper making machines that are rendered contamination resistant, maintain good permeability, and enhanced seam strength as a result of a durable coating that lasts the entire life of the fabric.

BACKGROUND OF THE INVENTION

The modern papermaker employs a highly sophisticated papermaking machine which is in essence a device for removing water from the paper furnish. The water is removed sequentially in three stages or sections of the machine. In the first or forming section, the furnish is deposited on a moving forming fabric and water drained through the fabric to leave a paper sheet or web having a solids content of about 18 to 25 percent by weight. The formed web is carried into a press fabric section and passed through one or more nip presses on a moving press fabric to remove sufficient water to form a sheet having a solids content of about 36 to 50 percent by weight. This sheet is then transferred to the dryer section of the papermaking machine where dryer fabrics hold the paper sheet against hot, steam-heated dryer cylinders to obtain about 92 to 96 percent solids content. The papermaking fabrics employed on the papermaking machine must perform a diverse range of functions, according to the position on the machine, i.e., forming, press or dryer section.

Forming fabrics used in the papermaking process are a kind of papermaking fabric which are used in the forming section of a papermaking machine. Forming fabrics are generally constructed of synthetic yarns joined together, ordinarily by weaving, in a fabric construction that is characterized by a high degree of open spaces between the intersecting yarns. Forming fabrics must maintain a high degree of openness to insure that they permit removal of water from the fiber slurry deposited thereon.

Since water removal capability is a critical function of the forming fabric, it is necessary to insure that the fabric retains a high degree of openness over its lifetime.

However, the degree of openness of a fabric is continually reduced during its life. In addition to the fiber slurry, paper pulp ordinarily contains additives such as filler clay, pitch, and polymeric materials that clog the open spaces of the fabric. The use of recycled fibers has introduced considerable amounts of contaminants in the form of inks, adhesives, tars, and polymeric materials, which also clog the open spaces of the fabric.

In addition, forming fabric designs now include multilayer fabrics that are more susceptible to contamination problems.

Accordingly, it is desirable to provide a fabric which exhibits an improved degree of contamination resistance. One proposed prior art solution is the use of contamination resistant yarns in the construction of the fabric. This has not proved to be wholly satisfactory since the contamination resistance provided by such yarns is short-lived and/or ineffective. Another proposed solution calls for coating or treating paper making fabrics in order to improve their resistance to contaminants. Again, this method is not wholly successful because the contamination resistance provided by the coating is short-lived and/or ineffective.

One problem inherent to coatings or treatments is that coatings per se are known to reduce the permeability of a fabric, an undesired result that inhibits water removal capabilities, the primary function of a forming fabric. It is therefore important that any coating applied to a forming fabric reduce permeability as little as possible.

It is also desirable to improve shear stability of a papermachine clothing. Shear stability is the degree to which the filaments of a fabric can shift before opposing filaments lock them into place.

U.S. Pat. No. 5,207,873 discloses a coating for papermaking fabrics in order to render them contaminant proof by increasing the anti-stick properties of the fabric. The fabric is treated with 1% solids solution containing poly (tetrafluoroethylene), urethane copolymers, polyacrylamide, acrylic copolymer, methylene bisacrylamide, polyaziridine cross linker, methyl pyrolidone, ammonium persulfate solution, sodium metabisulfate solution, urea peroxide solution, and silver nitrate solution, the components being present in the coating in the amounts and concentrations set forth in the disclosure. This coating has not proved to be totally effective and/or permanent on paper machine clothings.

SUMMARY OF THE INVENTION

An object of the present invention is to provide a fabric used in the forming, pressing, or drying section of a paper making machine that exhibits an improved resistance to contamination over the entire life of the fabric.

It is a further object of the invention to provide a coating that enhances the durability of the fabric.

It is a further object of the invention to provide a coating that enhances the shear stability of the fabric.

It is a further object of the invention to provide a coating that enhances the seam strength of the fabric.

It is a further object of the invention to provide a coating which does not significantly affect the permeability of the fabric.

It is a further object of the invention to provide a coating applied in thin, low weight coats.

It is a further object of the present invention to provide a coating for a fabric used in a papermaking machine that achieves the aforementioned objectives.

The present invention is a coated fabric used in a papermaking machine that has significantly enhanced resistance to contamination which lasts over the entire fabric lifetime. In another aspect, the invention is a method of coating a fabric used in a papermaking machine to enhance its resistance to contamination. The coating disclosed herein has been shown to substantially improve the contamination resistance of the coated fabrics, while not significantly reducing the permeability of the fabric, and not increasing the mass of the fabric to any significant degree. That is, the present invention provides a thin, low weight coating for a papermachine clothings that adds limited extra mass to the fabric.

In another aspect of the invention, the coating has been shown to increase the seam strength of a fabric.

In another aspect of the invention, the coating has been shown to increase the shear stability of a fabric.

Thus, the coating which is applied in thin layers, enhances the above-noted properties, improving fabric performance.

The applicants have found that a polyurethane based coating containing a fluorochemical will render the fabric contamination resistant over the entire fabric lifetime. It has been found that optical brighteners and titanium dioxide also enhance fabric appearance.

DETAILED DESCRIPTION OF THE PREFERRED EMBODIMENT

Figure 1:
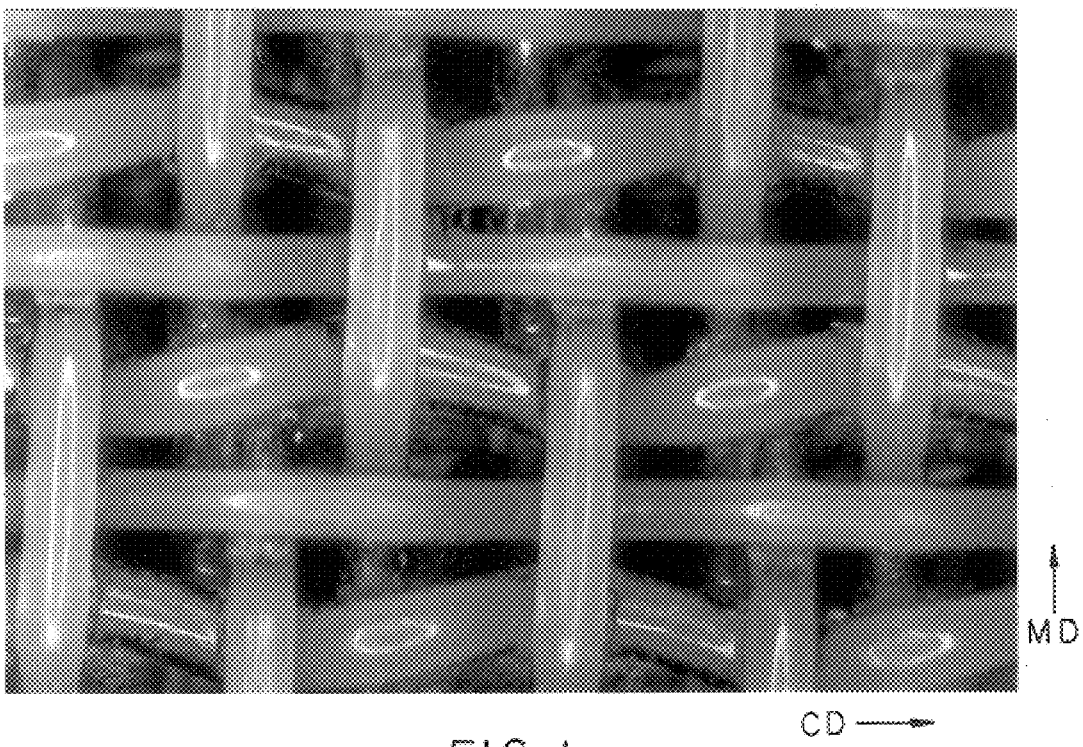
FIG. 1 is a photograph of fabric coated in accordance with the present invention after running on a machine.

Materials suited for use in the coating of the present invention are described below.

Several different polyurethane materials may be used in the present invention. Among commercially available products, suitable polyurethanes include water based urethanes such as Carver Tripp's Superpolyurethane, available from Parks Corp., Fall River, Mass., U.S.A., Bayhydrol 123 from Mobay Chemical, Inc., and Permuthane®, from ICI Chemicals, Ltd.

Suitable fluorochemicals include fluoro-substituted, water-dispersible polymeric materials such as: Fluorad® FC 722 or FC 724 from 3M (perfluorinated acrylates), Burco® PEL SRF, and Burco® PEL 5556, available from Burlington Chemical Co., Inc., Burlington, N.C.; Zonyl® FS-300 (fluoroalkyl alcohol substituted monoether with polyethylene glycol, available from DuPont), Zonyl® 8300 (fluorinated acrylic), Zonyl® intermediates (fluoroalkylacrylate, fluoroalkylmethacrylate), aqueous dispersions of poly(tetrafluoroethylene), (Teflon®, available from DuPont, Fluon®, available from ICI, Ltd., and Xylan® 300, available from Whitford Corp., West Chester Pa.), aqueous dispersions of poly(chlorotrifluoroethylene) (Aclar®, available from Allied Signal, Inc.) aqueous dispersions of fluorinated ethylene propylene (FEP), (available from DuPont as Teflon® and Xylan® 1700 series, available from Whitford Corp.), aqueous dispersions of perfluoroalkoxy (PFA, available as Teflon® PFA and Xylan® 1700 series from Whitford Corp.), fluorinated polyurethanes such as fluorinated diol intermediates with diisocyanates, polymeric fluorosurfactants such as fluorinated alkyl esters (such as Fluorad® FC-430, FC-431, FC-740 available from 3M and Zonyl available form DuPont), fluoroalkyl alcohol substituted monoether with polyethylene glycol (available as Zonyl® FS-300 from DuPont), and copolymers of perfluoroalkyl acrylates or methacrylate. Suitable optical brighteners include products available under the Blankophor tradename from Bayer AG, Leverkusen, Germany, such as Blankophor SOL, (BenzoPyranone), Blankophor P167, (stilbene disulfonic acid, sodium salt derivative), as well as 2,2'-(1,2-ethenediyl)bis(4,1-phenylene)bisbenzoxazole available from Eastern Chemical Company as Eastobrite OB-1. Optical brighteners are well known additives for thermoplastics and other materials which reduce yellowing and improve whiteness and enhance brightness of a product. Titanium dioxide ($TiO_2$) is available from Aldrich.

A particularly well suited combination for a coating is Carver Tripp's Superpolyurethane, Burco PEL 5556, Blankophor P167 optical brightener, and titanium dioxide. Burco PEL SRF and Burco PEL 5556 are copolymers of perfluoroalkyl acrylates or methacrylates in solution.

Effective contamination resistant fabrics have been prepared where the fabric coating contains no diluents such as water, or other solvents. However, a greater degree of the original permeability of a coated fabric is retained when the solids content of the coating is reduced. Water is a preferred diluent since it is inexpensive and compatible with water-based polyurethanes. It has been found that fabrics coated with coatings having a solids content of about 10% to 15% (w/w) maintain a high degree of their original permeability, that is, on the order of about 90%–99% of their original permeability. That is, permeability is reduced only about 1%–10% as a result of the coating. Preferred solids content has been found to be about 10–15%.

The fabrics can be coated in any conventional manner, including immersion within a coating bath, blade or bar coating techniques, squeegee coating, transfer coating, spraying, kiss or applicator roll, slot applicator, and brush applicator. Application with a kiss roll has been effective. The coating can be applied in a single pass, or it may be applied in multiple passes. Subsequent processing requires removing excess material and then drying or curing the coating as directed by the manufacture of that particular material. These methods are well known by those skilled in the art.

The following examples illustrate the invention and its applicability.

EXAMPLES 1–21

Twenty one coatings combinations were prepared that contain one or more of the following:

Polyurethane: Carver Tripp's SuperPoly;

Flourochemical: 1) Burco PEL SFR; 2) Burco PEL 5556, Optical Brightener: 1) Eastobrite OB-1; 2) Blankophor SOL; 3) Blankophor P 167, Optical Brightener Enhancer: 1) Titanium Dioxide ($TiO_2$). Each of the twenty one coatings were applied to a fabric in three separate locations, referred to as spots. The fabric was run on a high speed newsprint machine that has exhibited contamination problems from deinked furnish. The compositions of the coatings of Examples 1–21 are set forth in Table 1. All of the spots were shown to exhibit improved resistance to contamination, with the best results being shown by Example 12. The spots exhibited resistance to contamination over the entire life of the fabric, as the fabric ran for eighty-four (84) days.

TABLE 1

| Ex | Spots | | | Polyurethane | % | Flourochemical | % | Optical Brightener | % | Other | % |
|---|---|---|---|---|---|---|---|---|---|---|---|
| 1 | 24 | 36 | 61 | SuperPoly | 90 | Burco PEL SFR | 9.5 | Eastobrite OB-1 | 0.5 | | |
| 2 | 23 | 35 | 37 | SuperPoly | 90 | Burco PEL SFR | 9.5 | Blankopbor SOL | 0.5 | | |
| 3 | 9 | 33 | 57 | SuperPoly | 90 | Burco PEL SRF | 9.5 | Blankophor P 167 | 0.5 | | |
| 4 | 5 | 8 | 58 | SuperPoly | 90 | Burco PEL 5556 | 9.5 | Eastobrite OB-1 | 0.5 | | |

TABLE 1-continued

| Ex | Spots | | | Polyurethane | % | Flourochemical | % | Optical Brightener | % | Other | % |
|---|---|---|---|---|---|---|---|---|---|---|---|
| 5 | 30 | 38 | 63 | SuperPoly | 90 | Burco PEL 5556 | 9.5 | Blankophor SOL | 0.5 | | |
| 6 | 21 | 29 | 55 | SuperPoly | 90 | Burco PEL 5556 | 9.5 | Blankophor P 167 | 0.5 | | |
| 7 | 6 | 31 | 46 | SuperPoly | 90 | Burco PEL SRF | 9 | Eastobrite OB-1 | 0.5 | TiO2 | 0.5 |
| 8 | 12 | 13 | 17 | SuperPoly | 90 | Burco PEL SRF | 9 | Blankophor SOL | 0.5 | TiO2 | 0.5 |
| 9 | 14 | 15 | 56 | SuperPoly | 90 | Burco PEL SRF | 9 | Blankophor P 167 | 0.5 | TiO2 | 0.5 |
| 10 | 2 | 39 | 59 | SuperPoly | 90 | Burco PEL 5556 | 9 | Eastobrite OB-1 | 0.5 | TiO2 | 0.5 |
| 11 | 1 | 20 | 41 | SuperPoly | 90 | Burco PEL 5556 | 9 | Blankophor SOL | 0.5 | TiO2 | 0.5 |
| 12 | 3 | 28 | 48 | SuperPoly | 90 | Burco PEL 5556 | 9 | Blankophor P 167 | 0.5 | TiO2 | 0.5 |
| 13 | 22 | 43 | 44 | SuperPoly | 95 | Burco PEL SRF | 5 | | | | |
| 14 | 10 | 16 | 49 | SuperPoly | 91 | Burco PEL SRF | 9 | | | | |
| 15 | 4 | 45 | 51 | SuperPoly | 87 | Burco PEL SRF | 13 | | | | |
| 16 | 11 | 26 | 42 | SuperPoly | 83 | Burco PEL SRF | 17 | | | | |
| 17 | 18 | 34 | 50 | SuperPoly | 95 | Burco PEL 5556 | 5 | | | | |
| 18 | 532 | 40 | 60 | SuperPoly | 91 | Burco PEL 5556 | 9 | | | | |
| 19 | 25 | 54 | 62 | SuperPoly | 87 | Burco PEL 5556 | 13 | | | | |
| 20 | 19 | 27 | 53 | SuperPoly | 83 | Burco PEL 5556 | 17 | | | | |
| 21 | 7 | 47 | 52 | SuperPoly | 100 | | | | | | |

EXAMPLE 22

The following coating was prepared, using the components of Example 12.

55 gal. Superpoly polyurethane;

10 gal. Burco PEL 5556 fluorochemical;

20 grams Blankophor P167 optical brightener;

650 grams $TiO_2$

The Blankophor and the $TiO_2$ were mixed in a 5 gallon bucket containing water and then added to the other components.

Next, 25 gallons of the coating described in this example was diluted with 25 gallons of water to a 50% concentration containing approximately 14% solids. The coating and water were thoroughly mixed in a mixing device.

Several applications were made using either 100% or 50% concentration to two tests fabrics, Sensotex® triple layer fabric and Duotex® double layer fabric, both available from Albany International Corp., Albany, N.Y. The fabrics were analyzed to determine permeability before and after coating. The data is presented below in Table 5.

All coatings were applied via kiss roll applicator. Application conditions were 1.75 KN/M, 4 M/min, 0.034 bar vacuum.

TABLE 5

| | Number of Coatings | Air Perm (cfm) | % Decrease | Drop in CFM |
|---|---|---|---|---|
| Duotex'® | Before Treat | 473,468 | 0 | 0 |
| | 100% 3 | 410,415 | 12.3 | 31.5 |
| | 50% 2 | 448,461 | 3.4 | 16 |
| | 50% 3 | 456,451 | 3.6 | 17 |
| | 50% 4 | 448,443 | 5.3 | 25 |
| Sensotex ® | Before Treat | 535,537 | 0 | 0 |
| | 100% 3 | 491,491 | 8.4 | 45 |
| | 50% 2 | 524,526 | 2.1 | 11 |
| | 50% 3 | 517,515 | 3.7 | 20 |
| | 50% 4 | 513,511 | 4.1 | 24 |

EXAMPLE 23

A 10% solids solution of the coating of example 12 was prepared. Suitable proportions for a coating containing 10% solids are:

20 gallons Carver Tripp's Superpolyurethane 40 gallons water

3⅓ gallons Burco PEL 5556

6⅔ g. Eastobrite OB-1

226 g. $TiO_2$

The coating was applied as set forth in the previous examples. The coated fabrics were analyzed for purposes of determining whether the coating enhanced seam strength. It was found that the coated samples exhibit improved seam strength, on the order of about 45 pli, or about 25% over an uncoated fabric. Results are set forth in Table 6. The shear of the fabric was also reduced to almost an immeasurable amount after coating, as set forth in Table 7.

TABLE 6

MULTILAYER COATED WITH 10% SOLIDS COATING SEAM STRENGTH (PLI)

| | |
|---|---|
| Uncoated 1 | 181.31 |
| Uncoated 2 | 177.48 |
| Average Uncoated | 179.4 |
| Treated 1 | 233.15 |
| Treated 2 | 217.71 |
| Treated 3 | 223.66 |
| Average Treated | 224.8 |

As reported in Table 7, Shear stability of the yarns of the fabric is assessed on a board wherein a fabric sample 250 mm×250 mm in size is moved in the machine direction in order to determine the distance moved prior to buckling the fabric. The fabric is then moved in the opposite direction. The total of the two measurements are added, divided by the total length of the sample, and multiplied by 100 in order to give shear stability expressed as a percentage of length in the machine direction. The fabric is rotated, and the same assessment is made for the shear stability of the yarns of the cross machine direction.

TABLE 7

| | | TRIPLELAYER FABRIC | | | |
|---|---|---|---|---|---|
| | | MD Shear | | CD SHEAR | |
| TEST | POLYURETHANE | BEFORE COATING | AFTER COATING & SHOWERING | BEFORE COATING | AFTER COATING & SHOWERING |
| 1 | Parks SuperPoly Satin - 30% solids | 4% | 0% | 4% | 0% |
| 2 | Parks SuperPoly Satin - 15% solids | 4% | 1% | 4% | 1% |
| 3 | Parks SuperPoly Gloss - 30% solids | 4% | 0% | 4% | 0% |
| 4 | Parks SuperPoly Gloss - 15% solids | 4% | 1% | 4% | 1% |
| 5 | Parks Sanding Sealer - 24% solids | 4% | 1% | 4% | 1% |

Shear is measured as the free movement of a 250 mm sample.
Showering took place at 400 psi for 8 hours with .040" oscillating needle showers.

EXAMPLE 24

Two forming fabrics, each on the positions of a twin wire forming machine were coated with a 10% solids coating described in example 23 above and run on a high speed newsprint machine. The furnish consisted of 20% recycled and de-inked stock. High pressure showers were used on the fabrics. The conveying fabric was exposed to showers of 300–475 psi. The backing fabric was exposed to showers of 250–350 psi.

Running on the newsprint machine, the fabrics were exposed to pitch, ink and fillers. The fabrics ran together for 91 days, which is the average expected life of the fabrics. When viewed under a microscope, it was evident that pitch and filler were absent from the fabric surface, indicating that the coating remained on the fabric for its entire lifetime, and was not removed in spite of the exposure to high pressure showers. The coating was still visible at the cross over points.

In this instance, the contamination resistance provided by the coatings eliminates the need for using cleaning chemicals on the fabrics, resulting in a substantial savings to the papermaker.

Figure 2:
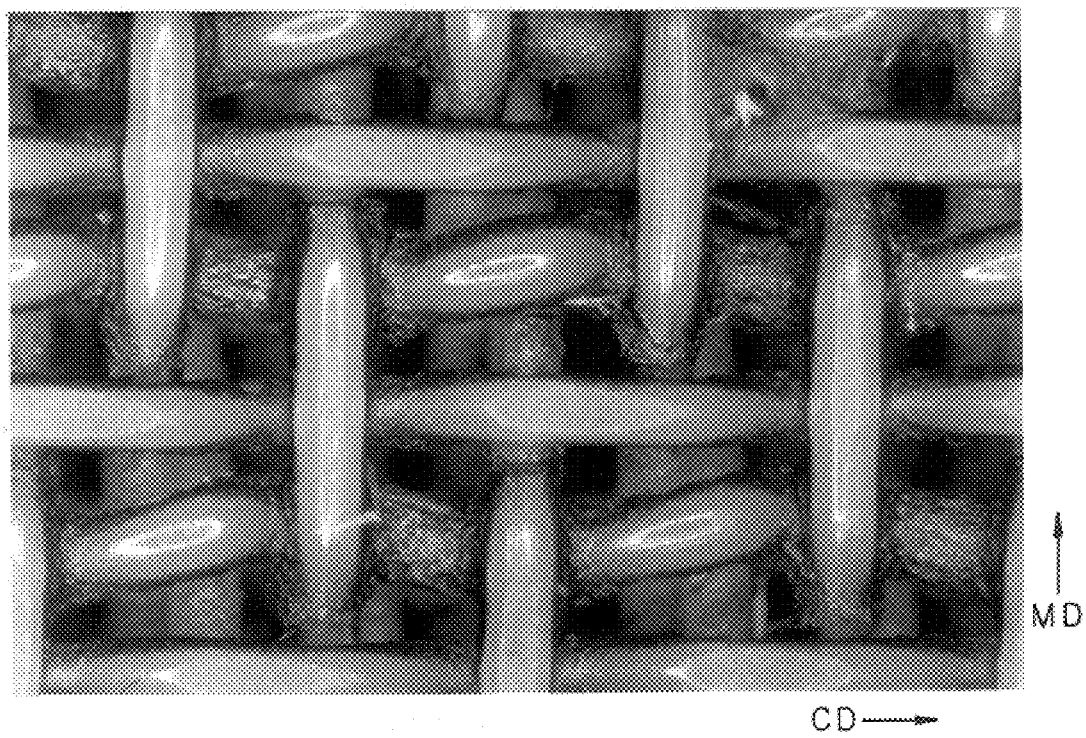
FIG. 2 is a photograph of an uncoated fabric of the same design as the fabric shown in FIG. 1 after running on a machine.

FIG. 1 is a photograph of the coated fabric (conveying fabric) after it was taken off the machine. There is an absence of contaminants from the fabric surface. FIG. 2 is a photograph of a fabric of the same design as the fabric of the invention shown in FIG. 1. The fabric of FIG. 2 was not coated and ran on the same machine for 84 days and was exposed to the same conditions. The presence of contaminants on the fabric is evident in the photograph.

EXAMPLE 25

A 30% solid coating was prepared containing the components of Example 23. The coating was applied in three separate applications as set forth in the previous examples. After each coat, the fabric was dried and cured. Prior to application of the first coat and after to applying each coating layer, the air permeability, mass added per coating layer, machine direction shear and cross machine direction shear of the fabric were determined. The coating was then diluted with water to reduce the solids content to 10% and subjected to the same procedure in order to assess the physical properties described above.

The mass samples were cut from the belts in circular patterns measuring 2" (0.0508 m) in diameter. It was found that after the first coating application at 10% solids, the average mass add-on was 3.62 g/m$^2$or 0.87% (w/w). After the first coating application at 30% solids, the average mass add-on was 9.37 g/m$^2$, or 2.28% (w/w). Additional layers will increase the coating mass added to the fabric.

EXAMPLE 26

A forming fabric was run on a pilot paper machine running pulp consisting of 100% old corrugated container (OCC). Four different coatings were applied to the fabric. They were:

A—uncoated control;

B—Carver Tripp's Superpolyurethane with Burco® PEL 5556 (10% solids);

C—Carver Tripp's Superpolyurethane, Burco® PEL 5556, and Blankophor P167 optical brightener (10% solids);

D—Carver Tripp's Superpolyurethane, Burco® PEL 5556, Blankophor P167 optical brightener, and TiO2 (10% solids).

Figure 3:
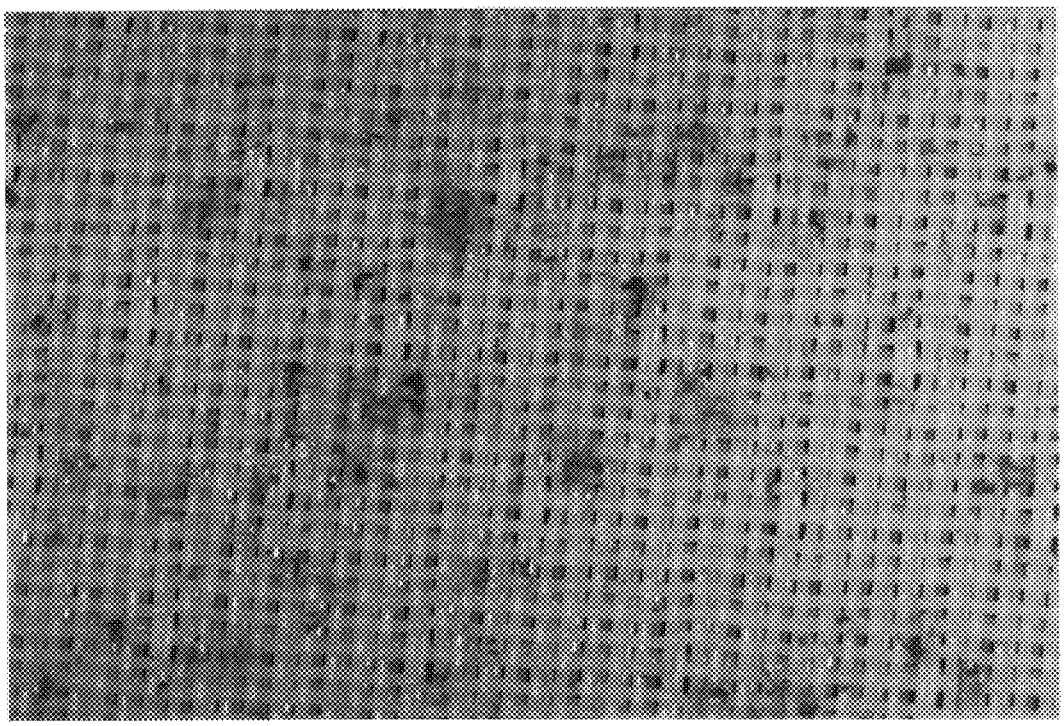
FIG. 3 is a photograph of an uncoated fabric after running on a machine, taken at 5× magnification.
Figure 4:
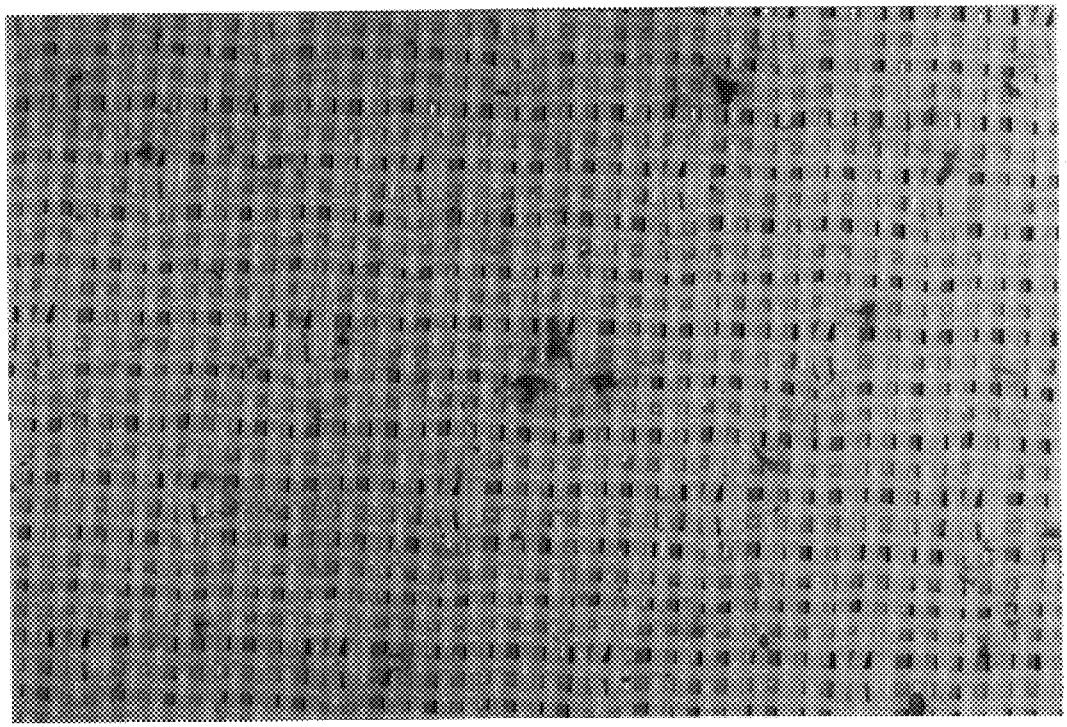
FIG. 4 is a photograph of a coated fabric after running on a machine, taken at 5× magnification.
Figure 5:
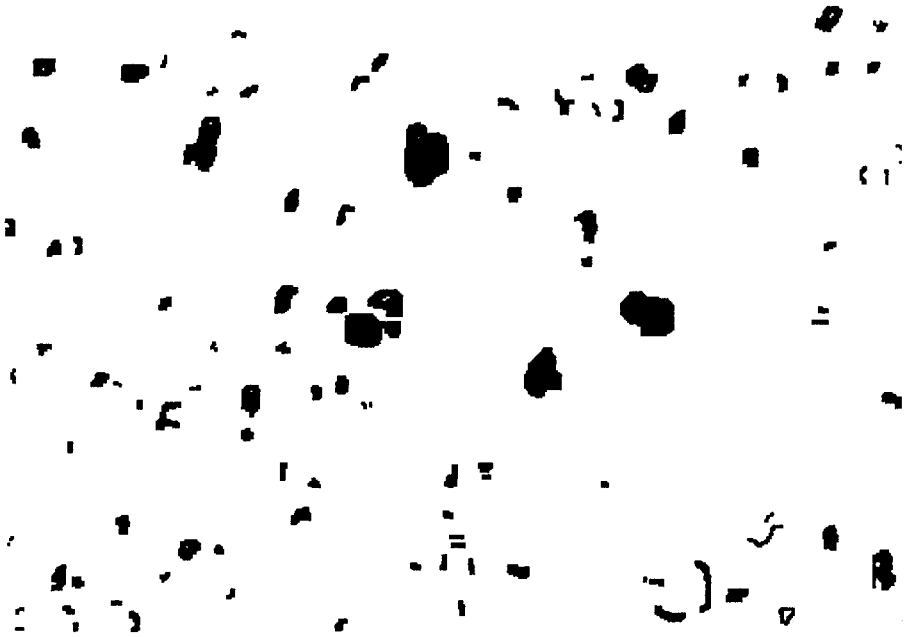
FIGS. 5 and 6 are the colored contaminated images of, respectively, an uncoated and coated fabric that were used to obtain a pixel count.
Figure 6:
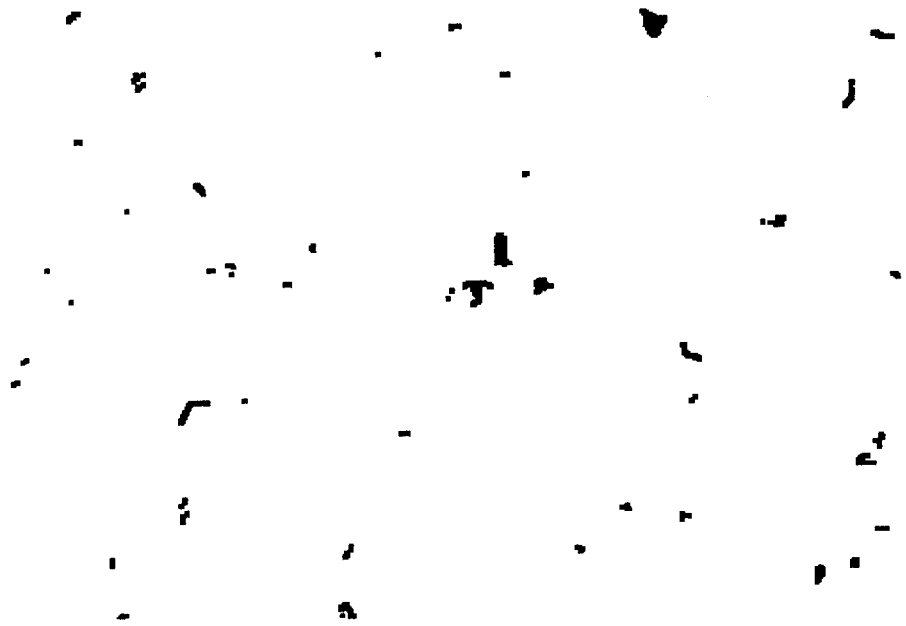

The fabric was run for 3 days at speeds ranging from 1500–2200 ft/min. Needle showers were used at 200 psi with no cleaning chemicals. After the trial, the fabric was removed and a contamination analysis was done on each area. FIG. 3 is a photograph of the uncoated fabric (A) was taken at 5× magnification, and FIG. 4 is a photograph of coating B (at 5× magnification). Photographs were also taken of the fabrics with coatings C and D. All photos were scanned into a computer with a gray color scale. In Microsoft Paintbrush, the contaminants were colored with blue. The gray fabric was removed from the image leaving only the blue left. This image was then loaded into another program which counted the blue pixels and found a % contaminated area. FIGS. 5 and 6 are the colored contaminated images of the fabrics with coatings A and B which were used for the pixel count. The results are listed below.

| COATING | % CONTAMINATED |
|---|---|
| A | 4.1 |
| B | 0.9 |
| C | 1.1 |
| D | 1.4 |

We claim:

1. A papermachine clothing for use in the forming, pressing or drying section of a papermaking machine comprised of a fabric having a high degree of openness which is constructed of yarns coated with at least one layer of a urethane-based coating including a copolymer of perfluoroalkyl acrylates or perfluoroalkyl methacrylates, wherein the clothings exhibit an improved resistance to contamination.

2. The papermachine clothing as set forth in claim 1 wherein the clothing is a multi layer fabric.

3. The papermachine clothing as set forth in claim 1 wherein the coating further comprises an optical brightener and a whitener.

4. The papermachine clothing of claim 3 wherein the optical brightener is selected from the group consisting of BenzoPyranone, stilbene disulfonic acid, sodium salt derivative, and 2,2'-(1,2-ethenediyl)bis(4,1 -phenylene) bisbenzoxazole.

5. The papermachine clothing as set forth in claim 4 wherein the whitener is titanium dioxide.

6. The paper machine clothing of claim 1 wherein the polyurethane is a water-based polyurethane.

7. The papermachine clothing as set forth in claim 1 wherein the coating comprises 5–30% solids on a weight basis.

8. The papermachine clothing as set forth in claim 1 wherein the coating comprises 10–15% solids on a weight basis.

9. The papermachine clothing of claim 1 wherein the coating is applied in at least two layers.

10. The papermachine clothing of claim 1 wherein the mass added to the fabric by the coating is in the range of 0.5% to 5% per application based upon the weight of the non-coated fabric.

11. The papermachine clothing as set forth in claim 1 wherein the coated clothing is cured.

12. The papermachine clothing as set forth in claim 1 wherein the clothing is a single layer fabric.

13. A papermachine clothing for use in the forming, pressing or drying section of a papermaking machine comprised of a fabric having a high degree of openness which is constructed of yarns coated with at least one layer of a urethane-based coating including a copolymer of perfluoroalkyl acrylates or perfluoroalkyl methacrylates, wherein the clothings exhibit an improvement in resistance to contamination and an improvement in either seam strength, shear stability, or both, when compared to noncoated fabrics.

14. The papermachine clothing as set forth in claim 13 wherein the clothing is a multi layer fabric.

15. The papermachine clothing as set forth in claim 13 wherein the clothing is a single layer fabric.

16. The papermachine clothing as set forth in claim 13 wherein the coating further comprises an optical brightener and a whitener.

17. The papermachine clothing of claim 16 wherein the optical brightener is selected from the group consisting of BenzoPyranone, stilbene disulfonic acid, sodium salt derivative, and 2,2'-(1,2-ethenediyl)bis(4,1-phenylene) bisbenzoxazole.

18. The papermachine clothing as set forth in claim 16 wherein the whitener is titanium dioxide.

19. The paper machine clothing of claim 13 wherein the polyurethane is a water-based polyurethane.

20. The papermachine clothing as set forth in claim 13 wherein the coating comprises 5–30% solids on a weight basis.

21. The papermachine clothing as set forth in claim 13 wherein the coating comprises 10–15% solids on a weight basis.

22. The papermachine clothing of claim 13 wherein the coating is applied in at least two layers.

23. The papermachine clothing of claim 13 wherein the mass added to the fabric by the coating is in the range of 0.5% to 5% per application based upon the weight of the non-coated fabric.

24. The papermachine clothing as set forth in claim 13 wherein the coated clothing is cured.

25. A contamination resistant papermachine clothing for use in the forming, pressing or drying section of a papermaking machine comprised of a fabric having a high degree of openness which is constructed of yarns coated with a coating including a polyurethane, a copolymer of perfluoroalkyl acrylates or perfluoroalkyl methacrylates, and an optical brightener.

26. The papermachine clothing as set forth in claim 25 wherein the clothing is a multi layer fabric.

27. The papermachine clothing as set forth in claim 25 wherein the clothing is a single layer fabric.

28. The papermachine clothing as set forth in claim 25 wherein the coated clothing is cured.

29. The papermachine clothing of claim 25 wherein the optical brightener is selected from the group consisting of BenzoPyranone, stilbene disulfonic acid, sodium salt derivative, and 2,2'-(1,2-ethenediyl)bis(4,1-phenylene) bisbenzoxazole.

30. The papermachine clothing as set forth in claim 25 wherein the coating is further comprised of titanium dioxide.

31. The paper machine clothing of claim 25 wherein the polyurethane is a water-based polyurethane.

32. The papermachine clothing as set forth in claim 25 wherein the coating contains 5–30% solids on a weight basis.

33. The papermachine clothing as set forth in claim 25 wherein the coating contains 10–15% solids on a weight basis.

34. The papermachine clothing of claim 25 wherein the coating is applied in at least two layers.

35. The papermachine clothing of claim 25 wherein the mass added to the fabric by the coating is in the range of 0.5% to 5% per application based upon the weight of the non-coated fabric.

36. A contamination resistant papermachine clothing for use in the forming, pressing or drying section of a papermaking machine comprised of a fabric having a high degree of openness which is constructed of yarns coated with a coating including a polyurethane, a copolymer of perfluoroalkyl acrylates or perfluoroalkyl methacrylates, an optical brightener, and a whitener.

37. The papermachine clothing as set forth in claim 36 wherein the clothing is a multi layer fabric.

38. The papermachine clothing as set forth in claim 36 wherein the clothing is a single layer fabric.

39. The papermachine clothing as set forth in claim 36 wherein the coated clothing is cured.

40. The papermachine clothing of claim 36 wherein the mass added to the fabric is in the range of 0.5% to 5% per application based upon the weight of the non-coated fabric.

41. The papermachine clothing of claim 36 wherein the optical brightener is selected from the group consisting of BenzoPyranone, stilbene disulfonic acid, sodium salt derivative, and 2,2'-(1,2-ethenediyl)bis(4,1-phenylene) bisbenzoxazole.

42. The papermachine clothing as set forth in claim 36 wherein the whitener is titanium dioxide.

43. The paper machine clothing of claim 36 wherein the polyurethane is a water-based polyurethane.

44. The papermachine clothing as set forth in claim 36 wherein the coating contains 5–30% solids on a weight basis.

45. The papermachine clothing as set forth in claim 36 wherein the coating contains 10–15% solids on a weight basis.

46. The papermachine clothing of claim 36 wherein the coating is applied in at least two layers.

47. A contamination resistant papermachine clothing for use in the forming, pressing or drying section of a papermaking machine comprised of a fabric having a high degree of openness which is constructed of yarns coated with a coating including a polyurethane, a copolymer of perfluoroalkyl acrylates or perfluoroalkyl methacrylates, an optical brightener, and a whitener, wherein the resistance to contamination is exhibited over the lifetime of the fabric and the fabric exhibits a reduction in air permeability of no greater than about 10%.

48. The papermachine clothing as set forth in claim 47 wherein the clothing is a multi layer fabric.

49. The papermachine clothing as set forth in claim 47 wherein the clothing is a single layer fabric.

50. The papermachine clothing as set forth in claim 47 wherein the coated clothing is cured.

51. The papermachine clothing of claim 47 wherein the mass added to the fabric by the coating is in the range of 0.5% to 5% per application based upon the weight of the non-coated fabric.

52. The papermachine clothing of claim 47 wherein the coating is applied in at least two layers.

53. The papermachine clothing of claim 47 wherein the optical brightener is selected from the group consisting of BenzoPyranone, stilbene disulfonic acid, sodium salt derivative, and 2,2'-(1,2-ethenediyl)bis(4,1-phenylene) bisbenzoxazole.

54. The papermachine clothing as set forth in claim 47 wherein the whitener is titanium dioxide.

55. The paper machine clothing of claim 47 wherein the polyurethane is a water-based polyurethane.

56. The papermachine clothing as set forth in claim 47 wherein the coating contains 5–30% solids on a weight basis.

57. The papermachine clothing as set forth in claim 47 wherein the coating contains 10–15% solids on a weight basis.

58. A method of imparting contamination resistance to paper machine clothings comprised of the steps of applying at least one layer of a coating to a fabric having a high degree of openness which is constructed of yarns, wherein the coating includes a polyurethane, a copolymer of perfluoroalkyl acrylates or perfluoroalkyl methacrylates, an optical brightener, and a whitener, and drying the coated fabric.

59. The method of claim 58 wherein the mass added to the fabric by the coating is in the range of 0.5% to 5% per application based upon the weight of the non-coated fabric.

60. The method as set forth in claim 58 wherein the fabric is a multi layer fabric.

61. The method as set forth in claim 58 wherein the fabric is a single layer fabric.

62. The method as set forth in claim 58 wherein the fabric is used in the forming, pressing or drying section of a papermaking machine.

63. The method as set forth in claim 58 wherein the coating contains 10–15% solids.

64. The method as set forth in claim 58 wherein the coating contains 5–30% solids.

65. The method of claim 58 wherein the optical brightener is selected from the group consisting of BenzoPyranone, stilbene disulfonic acid, sodium salt derivative, and 2,2'-(1,2-ethenediyl)bis(4,1-phenylene)bisbenzoxazole.

66. The method as set forth in claim 58 wherein the whitener is titanium dioxide.

67. The method of claim 58 wherein the polyurethane is a water-based polyurethane.

68. The method of claim 58 wherein the coated fabric is cured.

69. The method as set forth in claim 58 wherein the coating is applied to the fabric two or more times.

* * * * *